United States Patent [19]

Wood

[11] Patent Number: 4,586,998

[45] Date of Patent: May 6, 1986

[54] ELECTROLYTIC CELL WITH LOW HYDROGEN OVERVOLTAGE CATHODE

[75] Inventor: Nicholas S. Wood, Cheshire, England

[73] Assignee: Imperial Chemical Industries PLC, London, England

[21] Appl. No.: 642,166

[22] Filed: Aug. 20, 1984

[30] Foreign Application Priority Data

Aug. 31, 1983 [GB] United Kingdom ..... 8323390

[51] Int. Cl.[4] ..... C25B 9/00; C25B 11/08; C25D 3/52

[52] U.S. Cl. ..... 204/252; 204/47; 204/290 R

[58] Field of Search ..... 204/47, 290 R, 290 F, 204/252

[56] References Cited

U.S. PATENT DOCUMENTS

| | | | |
|---|---|---|---|
| 3,592,750 | 7/1971 | Lee | 204/95 |
| 4,100,049 | 7/1978 | Brannan | 204/242 |
| 4,273,624 | 6/1981 | Laitinen et al. | 204/23 |
| 4,416,742 | 11/1983 | Kinase et al. | 204/47 |

FOREIGN PATENT DOCUMENTS

| | | | |
|---|---|---|---|
| 247093 | 5/1966 | Austria | 204/47 |
| 117181 | 10/1976 | Japan | 204/290 F |
| 51-117181 | 10/1976 | Japan | 204/290 F |
| 54-090080 | of 1979 | Japan | 204/290 R |
| 54-110983 | 8/1979 | Japan | 204/290 R |
| 576529 | 6/1976 | Switzerland | 204/290 R |
| 1237077 | 6/1971 | United Kingdom | 204/47 |
| 1511719 | 5/1978 | United Kingdom | 204/290 R |

OTHER PUBLICATIONS

K. Schumpelt, Trans. Electrochem. Soc., vol. 80, pp. 489–498, (1941).

*Primary Examiner*—G. L. Kaplan

*Attorney, Agent, or Firm*—Cushman, Darby & Cushman

[57] ABSTRACT

A method of producing a cathode which operates at low hydrogen over-voltage in the electrolysis of water or aqueous solutions by electrodepositing on a nickel or nickel alloy substrate a coating comprising at least an outer layer of at least one platinum group metal, the outer layer of the platinum group metal being deposited from a plating bath which contains a solution of at least one platinum group metal compound and at least one additive of the type which supresses maxima in polarographic waves associated with reactions carried out at a dropping mercury electrode, said additive being further selected from those which do not react with the platinum group metal in the plating bath.

10 Claims, No Drawings

ELECTROLYTIC CELL WITH LOW HYDROGEN OVERVOLTAGE CATHODE

This invention relates to production of a cathode for use in an electrolytic cell, and in particular to production of a cathode which has a low hydrogen over-voltage when used in the electrolysis of water or aqueous solutions, e.g. aqueous alkali metal halide solutions.

The voltage at which an aqueous solution may be electrolysed is made up of the sum of a number of elements, namely the theoretical electrolysing voltage, the over-voltages at the anode and cathode, the resistance of the solution which is electrolysed, the resistance of the diaphragm or membrane, if any, positioned between the anode and cathode, and the resistance of the metallic conductors and their contact resistances.

In view of the high cost of electrical power it is desirable to reduce the voltage at which a solution is electrolysed to as low a value as possible. In the electrolysis of water or aqueous solutions there is considerable scope for achieving such a reduction in electrolysing voltage by reducing the hydrogen over-voltage at the cathode.

There have been many prior proposals of means of achieving such a reduction in hydrogen over-voltage. For example, it is known that the hydrogen over-voltage at a cathode may be reduced by increasing the surface area of the cathode, for example by etching the surface of the cathode, e.g. in an acid, or by grit-blasting the surface of the cathode or by coating the surface of the cathode with a mixture of metals and selectively leaching one of the metals from the coating.

Other methods of producing a low hydrogen over-voltage cathode which have been described involve coating the surface of a cathode with an electro-catalytically-active material. Examples of prior disclosures of coated cathodes include the following.

U.S. Pat. No. 4,100,049 discloses a cathode comprising a substrate of iron, nickel, cobalt or alloys thereof and a coating of a mixture of a precious metal oxide, particularly palladium oxide, and a valve metal oxide particularly zirconium oxide.

British Pat. No. 1511719 discloses a cathode comprising a metal substrate, which may be ferrous metal, copper or nickel, a coating of cobalt, and a further coating consisting of ruthenium.

Japanese Patent Publication No. 54090080 discloses pre-treating an iron cathode with perchloric acid followed by sinter coating the cathode with cathode active substances, which may be ruthenium, iridium, iron or nickel in the form of the metal or a compound of the metal.

Japanese Patent Publication No. 54110983 discloses a cathode, which may be of mild steel, nickel or nickel alloy and a coating of a dispersion of nickel or nickel alloy particles and a cathode activator which comprises one or more of platinum, ruthenium, iridium, rhodium, palladium or osmium metal or oxide.

Japanese Patent Publication No. 53010036 discloses a cathode having a base of a valve metal and a coating of an alloy of at least one platinum group metal and a valve metal, and optionally a top coating of at least one platinum group metal.

A low hydrogen over-voltage cathode may be produced by applying such a coating to the surface of a cathode which has also been treated in order to increase the surface area of the cathode.

Many of the aforementioned cathodes, particularly those coated with a coating of an electro-catalytically-active material, suffer from the disadvantage that, although the initial hydrogen over-voltage at the cathode may be low, the hydrogen over-voltage tends to increase with time of use and the low hydrogen over-voltage performance may be short-lived.

The present invention relates to a method of production of a cathode the surface of which comprises an electrodeposited layer of a platinum group metal which cathode operates at low hydrogen over-voltage for a prolonged period of time when used in the electrolysis of water or aqueous solutions, and which is strongly adherent to the cathode substrate.

According to the present invention there is provided a method of producing a cathode by electro-depositing on a nickel or nickel alloy substrate a coating comprising at least an outer layer of at least one platinum group metal, characterised in that the said outer layer of the platinum group metal is electrodeposited from a plating bath which contains a solution of at least one platinum group metal compound and at least one additive of the type which supresses maxima in polarographic waves associated with reactions carried out at a dropping mercury electrode, hereinafter referred to as the additive, said additive being further selected from those which do not react with the platinum group metal compound in the plating bath.

The substrate of the cathode may be made of nickel or a nickel alloy or it may comprise a substrate of another material having an outer face of nickel or nickel alloy. For example, the cathode may comprise a core of another metal, e.g. steel, and an outer face of nickel or nickel alloy.

The substrate of the cathode may have any desired structure. For example, it may be in the form of a plate, which may be forminate, e.g. the cathode may be a perforated plate, or it may be in the form of an expanded metal, or it may be a woven or unwoven mesh. The cathode is not necessarily in plate form. Thus, it may be in the form of a plurality of so-called cathode fingers between which the anodes of the electrolytic cell may be placed.

As it assists in the production of a cathode which operates with a low hydrogen over-voltage it is desirable that the surface of the nickel or nickel alloy substrate has a high surface area. Such a high surface area may be achieved by roughening the surface of the nickel or nickel alloy substrate, for example by grit-blasing the surface, or by chemically etching the surface, or by anodically polarising the cathode in an acidic medium in order to etch the surfaces.

By "platinum group metal", or "platinum group metal compound", we mean a metal, or a compound thereof, selected from the group platinum, ruthenium, rhodium, palladium, iridium and osmium.

Plating baths containing a platinum group metal compound, and methods of application of a platinum group metal coating from such plating baths, are well known in the art.

Suitable compounds of a platinum group metal include, for example, inorganic acid salts of platinum group metals, e.g. chlorides, nitrates, or sulphates. A particularly suitable platinum group metal compound is chloroplatinic acid.

The platinum group metal compound may be an organic acid salt of a platinum group metal, for example, an acetate, formate or a propionate.

The solution of the platinum group metal compound in the plating bath will generally be an aqueous solution, e.g. an aqueous solution of an acid.

In general, the concentration of the platinum group metal compound in the plating bath will be in the range 0.1 g/1 to 20 g/1 based on the platinum in the compound, although it is to be understood that this concentration range is not limiting and that platinum group metal compound concentrations outside this range may be used if desired. An upper limit of the platinum metal compound concentration may be set by the solubility of the compound, and it may be preferred not to use a very low concentration as the current efficiency of the plating process may be undesirably low.

In effecting the electrodeposition the nickel or nickel alloy substrate is placed in the plating bath and electrically connected as a cathode and electrolysis is effected with an anode of a platinum group metal or of another metal which has a surface of a platinum group metal, e.g. a platinum group metal coated titanium anode. A suitable cathode current density at which to effect the electrodeposition is in the range 10 to 1000 Amps per square meter ($A/m^2$) of cathode surface, although current densities outside this range may be used if desired. The lower is the current density used the longer will be the time required to produce a coating of a given thickness. At very high current densities the current efficiency of the plating process may be reduced and the adhesion of the coating may not be as great as may be desired.

The temperature of the plating bath may suitably be in a range from ambient temperature up to 100° C.

It is desirable that the plating bath be agitated during the electroplating process.

The plating bath may contain more than one platinum group metal compound so that the electro-deposited coating on the nickel or nickel alloy substrate comprises more than one platinum group metal.

Additives which suppress maxima in polargraphic waves are described, for example, in "The Principles and Applications of Polarography" by G. W. C. Millar, Longmans, 1957. Certain of these compounds, for instance methyl red and methylene blue reduce the platinum metal compounds in the plating baths and precipitate platinum group metal powder. Such compounds are excluded from the scope of the present invention as the additive for use in the method must be one which does not react with the platinum group metal compound in the plating bath.

Whether or not a particular additive of the type which suppresses maxima in polarographic waves reacts with a particular platinum group metal compound may be determined by means of simple experiment, e.g. by observing the effect of the additive on the platinum group metal compound in the plating bath.

Cathodes which comprise a nickel or nickel alloy substrate and an electrodeposited coating thereon of a platinum group metal, even if they possess a low initial hydrogen over-voltage when used in the electrolysis of water or aqueous solutions, show an increase in hydrogen over-voltage after only a short period of time. However, and by way of contrast, where the platinum group metal coating is applied from a plating bath which also comprises an additive as hereinbefore described, the cathode may be operated for a longer period of time, and generally for a prolonged period of time, at a low hydrogen overvoltage.

In carrying out the method of the invention the amount of the additive in the plating bath may vary over a wide range, and the operative range is not the same for all additives. Additives of low solubility in the solvent of the plating bath may be used up to the maximum solubility, whereas additives of high solubility may be found to prevent electrodeposition of the platinum group metal if used at high concentration. The latter usually exert their best effect at about half the minimum concentration which prevents electro-deposition of the platinum group metal. In general for there to be obtained a useful effect on the hydrogen over-voltage performance of the cathode a concentration of at least 1 part per million weight/volume of additive in the plating bath is required, although much higher concentrations may be used. The effect of change of the concentration of additive used in the plating bath on the rate of deposition of the coating may readily be determined by means of simple experiment, and will vary with the nature of the additive.

A suitable additive is gelatine. Other suitable additives are for instance ethoxylated alkyl phenols, agar-agar, gum arabic, high molecular weight polyethylene glycol, gum accacia, cellulose derivatives, e.g. methyl cellulose, bromo phenol blue, poly vinyl alcohol, the sodium salts of long chain alkyl benzene sulphonates, peptone, glycerol, the sodium salts of alkyl aryl polyether sulphonates, perfluoroalkyl sulphonates, e.g. alkali metal salts of perfluoroalkyl sulphonates. Suitable amounts of these additives will be apparent from the examples shown hereinafter.

The plating bath may contain more than one additive.

The adhesion of the coating on the substrate and the current efficiency of the electrodeposition is greater where the coating is deposited from a plating bath containing a solution of low pH. For this reason a pH of less than 5.0 is preferred, more preferably less than 2.

The whole of the platinum group metal coating of the cathode may be deposited on the nickel or nickel alloy substrate from a plating bath containing an additive as defined hereinbefore. However, it is within the scope of the invention to apply to the nickel or nickel alloy substrate an initial coating of a platinum group metal by electrodeposition from a conventional plating bath which does not contain an additive as hereinbefore described or, by other means, and only an outer surface layer of platinum group metal need then be deposited by electrodeposition from a plating bath containing the aforesaid additive to produce a surface in accordance with the method of the invention.

It is also within the scope of the invention to deposit the platinum group metal coating according to the method of the invention onto a coating of a material other than a platinum group metal on the surface of the nickel or nickel alloy substrate.

It is possible that the coating of platinum group metal deposited by electrodeposition in the method of the invention may contain some platinum group metal deposited by other means, for example by exchange with, or displacement of, nickel in the substrate of the cathode.

A suitable thickness of platinum group metal coating applied by the method of the invention is at least 0.1 micron based on the projected area of the cathode. The cathode will of course have a longer lasting low hydrogen overvoltage performance the greater is the thickness of the coating. The coating thickness may be 10 microns or greater.

The cathode produced in the method of the invention is particularly suitable for use in the electrolysis of water or aqueous solutions, for example, aqueous alkali metal chloride solutions, e.g. aqueous sodium chloride solutions, as it operates in such electrolysis at low hydrogen over-voltage for a prolonged period of time.

The cathode is suitable for use in an electrolytic cell comprising an anode, or a plurality of anodes, a cathode, or a plurality of cathodes, and optionally a separator positioned between each adjacent anode and cathode. The separator may be a porous electrolyte permeable diaphragm or it may be a hydraulically impermeable cation permselective membrane. The separator is preferably a membrane.

The anode in the electrolytic cell may be metallic, and the nature of the metal will depend on the nature of the electrolyte to be electrolysed in the electrolytic cell. A preferred metal is a film-forming metal, particularly where an aqueous solution of an alkali metal chloride is to be electrolysed in the cell.

The film-forming metal may be one of the metals titanium, zirconium, niobium, tantalum or tungsten or an alloy consisting principally of one or more of these metals and having anodic polarisation properties which are comparable with those of the pure metal. It is preferred to use titanium alone, or an alloy based on titanium and having polarisation properties comparable with those of titanium.

The anode may have a coating of an electro-conducting electro-catalytically active material. Particularly in the case where an aqueous solution of an alkali metal chloride is to be electrolysed this coating may for example consist of one or more platinum group metals, that is platinum, rhodium, iridium, ruthenium, osmium and palladium, or alloys of the said metals, and/or an oxide or oxides thereof. The coating may consist of one or more of the platinum group metals and/or oxides thereof in admixture with one or more non-noble metal oxides, particularly a film-forming metal oxide. Especially suitable electro-catalytically active coatings include platinum itself and those based on ruthenium dioxide/titanium dioxide, ruthenium dioxide/tin dioxide, and ruthenium dioxide/tin dioxide/titanium dioxide.

Such coatings, and methods of application thereof, are well known in the art.

Cation permselective membranes are known in the art. The membrane is preferably a fluorine-containing polymeric material containing anionic groups. The polymeric material is preferably a fluoro-carbon containing the repeating groups $$[C_mF_{2m}]_M \text{ and } [CF_2-\underset{\underset{X}{|}}{CF}]_N$$

where m has a value of 2 to 10, and is preferably 2, the ratio of M to N is preferably such as to give an equivalent weight of the groups X in the range 500 to 2000, and X is chosen from $$A \text{ or } [OCF_2-\underset{\underset{Z}{|}}{CF}]_p A$$

where p has the value of for example 1 to 3, Z is fluorine or a perfluoroalkyl group having from 1 to 10 carbon atoms, and A is a group chosen from the groups:

$-SO_3H$
$-CF_2SO_3H$
$-CCl_2SO_3H$
$-X^1SO_3H$
$-PO_3H_2$
$-PO_2H_2$
$-COOH$ and
$-X^1OH$ or derivatives of the said groups, where $X^1$ is an aryl group. Preferably A represents the group $SO_3H$ or $-COOH$. $SO_3H$ group-containing ion exchange membranes are sold under the tradename 'Nafion' by E. I. DuPont de Nemours and Co Inc and $-COOH$ group-containing ion exchange membranes under the tradename 'Flemion' by the Asahi Glass Co Ltd.

The invention is illustrated by the following Example.

EXAMPLE 1

A 10.5 $cm^2$ flat disc of nickel of 1 mm thickness (BS NA11 Vickers Hardness 100) was treated with trichloroethylene vapour to remove traces of oil and grease from the surface of the disc. The surface of the disc was then roughened by grit-blasting with 60–80 mesh fused alumina and the disc was then washed in aqua regia and finally in water. After drying the disc in a current of warm air the disc was immersed in a plating bath comprising water, chloroplatinic acid at a concentration of 1 g/l based on the platinum metal, and $2\times10^{-3}$ g/l of Triton X-100 (iso-octyl phenoxy polyethoxy ethanol) as additive. The plating bath had a pH of 2.8 and the temperature of the bath was maintained at 60° C.

The nickel disc was connected as a cathode in the plating bath and a platinum foil was used as the anode, and electrolysis was effected at a cathode current density of 240 $A/m^2$ for $4\frac{1}{4}$ minutes. The resultant platinum plated nickel disc was removed from the bath and washed with water and was found to have a coating of 1.02 micron thickness of platinum based on the projected surface area of the nickel.

The thus coated nickel disc was installed as a cathode in an electrolytic cell equipped with a titanium grid anode having a coating of 35% by weight $RuO_2$ and 65% by weight $TiO_2$, the anode and cathode being separated by a cation-exchange membrane comprising a perfluoropolymer having carboxylic acid ion-exchange groups and an ion-exchange capacity of 1.5 milliequivalents per gram of dry membrane.

A saturated aqueous solution of sodium chloride was charged continuously to the anode compartment of the electrolytic cell, the cathode compartment was filled with 25% by weight aqueous sodium hydroxide solution, and electrolysis was commenced at a current density of 3 $kA/m^2$ of cathode surface. Water was charged continuously to the cathode compartment at a rate sufficient to maintain a concentration of 35% by weight of sodium hydroxide in the cathode compartment.

The hydrogen over-voltage at the cathode as a function of time was measured, with the following results.

TABLE 1

| Time (days) | Hydrogen over-voltage (m volts) |
|---|---|
| 1 | 81 |
| 5 | 74 |
| 10 | 68 |
| 20 | 94 |
| 30 | 88 |
| 40 | 77 |

TABLE 1-continued

| Time (days) | Hydrogen over-voltage (m volts) |
|---|---|
| 50 | 91 |
| 60 | 97 |
| 70 | 97 |
| 90 | 71 |
| 110 | 84 |
| 130 | 98 |

By way of comparison the above procedure was repeated except that the Triton X-100 was omitted from the plating bath.

The hydrogen over-voltage at the cathode as a function of time was measured, with the following results

TABLE 2

| Time (days) | Hydrogen over-voltage (m volts) |
|---|---|
| 1 | 174 |
| 5 | 207 |
| 10 | 206 |
| 20 | 244 |
| 30 | 178 |
| 40 | 333 |
| 50 | 358 |
| 60 | 357 |
| 70 | 361 |

EXAMPLES 2 to 7

In eight separate examples the electroplating procedure of Example 1 was repeated on nickel cathodes under the following conditions.

Plating bath—chloroplatinic acid (1 g/l based on Pt) in water.

pH—1.45

Temperature—62° C.

Current density—190 A/m$^2$

Electroplating time—3 minutes

Triton X-100 additive—various concentrations.

Thereafter, the thus coated cathodes were installed in electrolytic cells and an aqueous sodium chloride solution was electrolysed therein, following the procedure as described in Example 1. The effect of the concentration of the Triton X-100 additive on the hydrogen over-voltage of the cathodes 1 day after electrolysis is shown in the following Table 3.

TABLE 3

| Example | 2 | 3 | 4 | 5 | 6 | 7 | comparison |
|---|---|---|---|---|---|---|---|
| Concentration of Triton X-100 ppm | 20 | 100 | 250 | 600 | 1000 | 4000 | 0 |
| Hydrogen over-voltage m volts | 94 | 53 | 63 | 125 | 101 | 359 | 194 |

EXAMPLES 8 to 17

In ten separate examples the electroplating procedure of Example 1 was repeated on nickel cathodes under the following conditions.

Plating bath—chloroplatinic acid in water (1 g/l based on Pt)

pH—1.45

Temperature—60° C.

Current density—217 A/m$^2$

Electroplating time - 1 minute

Additive - 1000 ppm (various)

Thereafter, the thus coated cathodes were installed in electrolytic cells and an aqueous sodium chloride solution was electrolysed therein, following the procedure as described in Example 1. The effect of the different additives on the hydrogen over-voltage of the cathodes is shown in the following Table 4.

TABLE 4

| Example | Weeks of Electrolysis | Hydrogen over-voltage m volts 0 | 1 | 2 | 3 | 4 | 5 | 6 | 7 | 8 |
|---|---|---|---|---|---|---|---|---|---|---|
| 8 | Triton X-100 | 82 | 66 | 54 | 86 | 70 | 66 | 67 | 74 | 164 |
| 9 | gelatin | 91 | 73 | 60 | 91 | 71 | 68 | 64 | 91 | 226 |
| 10 | polyethylene glycol | 143 | 119 | 126 | 179 | 160 | 170 | 134 | 222 | 309 |
| 11 | Lissapol (an ethoxylate of nonyl phenol) | 74 | 67 | 67 | — | 87 | 164 | 214 | 146 | 261 |
| 12 | methyl cellulose | 160 | 119 | 110 | 107 | 126 | 163 | 201 | 262 | |
| 13 | peptone | 99 | 114 | 133 | 155 | 194 | 220 | | | |
| 14 | gum accacia | 78 | 89 | 97 | 112 | 129 | 204 | | | |
| 15 | polyvinyl alcohol | 103 | 127 | 147 | 119 | 227 | | | | |
| 16 | bromophenol blue | 72 | 83 | 80 | 86 | 99 | 83 | | | |
| 17 | Fluorad 120 (a perfluoro alkyl potassium sulphonate) | 68 | 179 | 205 | 165 | 298 | | | | |
| Comparison | No additive | 114 | 125 | 331 | 336 | 353 | 365 | 302 | 377 | 339 |

I claim:

1. An electrolytic cell comprising an anode or a plurality of anodes, a cathode or a plurality of cathodes, and a separator positioned between each adjacent anode and cathode, in which the cathode or cathodes are produced by electro-depositing on a nickel or nickel alloy substrate a coating comprising at least an outer layer of at least one platinum group metal, wherein the said outer layer of the platinum group metal is deposited from a plating bath which contains a solution of at least one platinum group metal compound and at least one additive of the type which suppresses maxima in polarographic waves associated with reactions carried out at a dropping mercury electrode, said additive being further selected from those which do not react with the platinum group metal in the plating bath.

2. An electrolytic cell as claimed in claim 1 wherein the platinum group metal compound comprises a compound of platinum.

3. An electrolytic cell as claimed in claim 1 or claim 2 wherein the platinum group metal compound comprises chloroplatinic acid.

4. An electrolytic cell as claimed in claim 1 wherein the solution of the platinum group metal compound is an aqueous solution.

5. An electrolytic cell as claimed in claim 1 wherein the concentration of platinum group metal compound in the plating bath is in the range 0.1 g/l to 10 g/l.

6. An electrolytic cell as claimed in claim 1 wherein the electrodeposition is effected at a cathode current density in the range 10 to 1000 Amps per Square meter of cathode surface.

7. An electrolytic cell as claimed in claim 1 wherein the concentration of the additive in the solution is at least 1 part per million weight/volume.

8. An electrolytic cell as claimed in claim 1 wherein the additive is selected from gelatin, bromophenol blue, and isooctylphenoxy-polyethoxy ethanol.

9. An electrolytic cell as claimed in claim 1 wherein the pH of the solution is less than 2.0.

10. An electrolytic cell as claimed in claim 1 wherein the deposited platinum group metal has a thickness of at least 0.1 micron.

* * * * *